US006138474A

United States Patent [19]

Smith, IV et al.

[11] Patent Number: 6,138,474

[45] Date of Patent: Oct. 31, 2000

[54] ARGON PRODUCTION CONTROL THROUGH ARGON INVENTORY MANIPULATION

[75] Inventors: Oliver Jacob Smith, IV, New Tripoli; Stephen Andrew Cronauer, Mertztown, both of Pa.

[73] Assignee: Air Products and Chemicals, Inc., Allentown, Pa.

[21] Appl. No.: 09/240,941

[22] Filed: Jan. 29, 1999

[51] Int. Cl.[7] ..... F25J 3/00

[52] U.S. Cl. ..... 62/656; 62/924

[58] Field of Search ..... 62/656, 524, 643

[56] References Cited

U.S. PATENT DOCUMENTS

| | | | |
|---|---|---|---|
| 4,784,677 | 11/1988 | Al-Chalabi | 62/656 |
| 4,842,625 | 6/1989 | Allam et al. | 62/22 |
| 5,448,893 | 9/1995 | Howard et al. | 62/656 |
| 5,505,051 | 4/1996 | Darredeau et al. | 62/656 |
| 5,522,224 | 6/1996 | Canney | 62/656 |
| 5,590,544 | 1/1997 | Corduan et al. | 62/656 |
| 5,724,835 | 3/1998 | Hine | 62/646 |

FOREIGN PATENT DOCUMENTS

DE3436897C2 1/1993 Germany .

*Primary Examiner*—William Doerrler
*Attorney, Agent, or Firm*—Willard Jones, II

[57] ABSTRACT

In a process for the cryogenic separation of air and recovery of argon in a distillation system having at least one distillation column that produces a nitrogen-enriched stream, an oxygen enriched stream, and an argon-enriched stream, and at least one sidearm column which receives the argon-enriched stream from the distillation column, controlling argon recovery by manipulating the total amount of argon inventory within the system at a given time.

27 Claims, 4 Drawing Sheets

ARGON PRODUCTION CONTROL THROUGH ARGON INVENTORY MANIPULATION

CROSS REFERENCE TO RELATED APPLICATIONS

Not applicable

STATEMENT REGARDING FEDERALLY SPONSORED RESEARCH OR DEVELOPMENT

Not applicable

FIELD OF THE INVENTION

The present invention relates to a cryogenic air separation process. More particularly, the present invention relates to a process for the control of overall argon production through a manipulation of the argon inventory in the system.

BACKGROUND OF THE INVENTION

A common method of recovering argon from air is to use a double column distillation system consisting of a higher pressure column and lower pressure column thermally linked with a reboiler/condenser. This method also includes the use of a sidearm rectifier column attached to the lower pressure column. The oxygen product is withdrawn from the bottom of the lower pressure column and at least one nitrogen-enriched stream is withdrawn from the top of the lower pressure column. The relative volatilities of nitrogen, argon, and oxygen force argon to accumulate in an intermediate section of the lower pressure column. Thus, to produce an argon-enriched product, a portion of the vapor rising through the lower pressure column is withdrawn from this intermediate location and passed to a sidearm column.

The portion passed to the sidearm column generally contains between 3 mole % and 25 mole % argon, traces of nitrogen, and balance oxygen. This first argon-enriched stream is rectified in the sidearm column to produce a second argon-enriched stream substantially purified of oxygen. Typically, this second argon-enriched stream is withdrawn from the top of the sidearm column with an oxygen content ranging from less than 1 ppm to 3 mole % oxygen. The rectification is achieved by providing liquid reflux to the sidearm column via a condenser located at its top.

The sidearm column need not be contained in only one vessel but can be split into more than one vessel. Each vessel is connected to the next in the series by a vapor and liquid stream from its top to the bottom of the next vessel. The bottom of the first vessel is attached to the lower pressure column and the top of the last vessel contains a condenser as described above. Typical practice is to limit the total height of the cryogenic system when the sidearm column becomes too tall by splitting it into two or more vessels.

Due to the high value of argon, it is important to maximize the production of the enriched argon product stream. To maintain a high argon product flow rate, it is important to limit the nitrogen content in the vapor feed stream to the sidearm column. If the nitrogen content of the feed stream increases, the nitrogen tends to accumulate in the condenser located at the top of the sidearm column. Such an accumulation of nitrogen decreases the condensing capability of the condenser which in turn lowers the performance of the sidearm column by decreasing the amount of vapor that can be fed to the column.

U.S. Pat. No. 4,784,677, U.S. Pat. No. 4,842,625, and U.S. Pat. No. 5,448,893 all disclose processes for maximizing the recovery of argon from a cryogenic air separation system. Patentees in each instance disclose ways to operate at the upper limit of the nitrogen flow rate to the sidearm column during normal steady-state operation. None, however, address the problem of how to operate at the lower limit of the argon concentration in the oxygen product stream in the presence of increased argon accumulation due to process or product rate transients.

The oxygen product, which is withdrawn from the bottom of the lower pressure column, generally contains between 0.1 mole % and 2 mole % argon when an argon enriched product is co-produced. The oxygen product purity is usually allowed to vary in a dead-band range above the required customer purity specifications and is only controlled when it approaches the minimum purity range, defined by customer need. Thus, even if the oxygen product stream is operating at or above the minimum purity required, argon is escaping from the system as an impurity in the oxygen product stream.

It is known to recover this potential argon product from the oxygen product stream by increasing the enriched-argon stream flow rate out of the sidearm column while maintaining appropriate nitrogen levels. This method causes the increased recovery of argon as product. Conditions can exist in the process, however, that render the above method ineffective. In such circumstances, argon in the oxygen product stream cannot be controlled by increasing the enriched-argon stream flow rate leaving the sidearm column because the enriched-argon product stream is either below the required purity or the flow rate can otherwise not be increased. In such circumstances, it is either not desirable or not possible to maintain the desired overall argon production by increasing the enriched-argon stream flow rate out of the sidearm column.

Several possible process conditions can exist that will result in not being able to control the argon lost from the system in the oxygen product stream by increasing the enriched argon product stream from the sidearm column. These are:

(1) The sidearm column is being started-up or restarted. To quickly re-establish the argon purity, argon-rich liquid inventory is re-introduced to the system while the sidearm column is operated at total reflux without a top product stream as disclosed by U.S. Pat. No. 5,505,051, and German Patent 34 36 897;

(2) The customer demand for argon either is constant or has been curtailed while the oxygen and nitrogen requirements have been increased; or (3) The sidearm column, or the entire air separation unit, is undergoing transient operation such as that caused by time-of-day contracts for which the production rates see large daily changes due to electrical power costs.

An improved process would allow for control of overall argon production without manipulating the flow of the argon-enriched stream from the sidearm column.

SUMMARY OF THE INVENTION

Therefore, in one aspect, the present invention is a process for separating mixtures which comprise oxygen, nitrogen, and argon by cryogenic distillation in a distillation system where the system is comprised of at least one distillation column that produces a nitrogen-enriched stream, an oxygen-enriched stream, and an argon-enriched stream, and a sidearm column which receives the argon-enriched stream from the distillation column. The process is characterized in that argon recovery is controlled by manipulating the total amount of argon inventory within the system.

In another aspect, the present invention is a process for separating mixtures which comprise oxygen, nitrogen, and argon by cryogenic distillation in a distillation system where the system is comprised of at least one distillation column that produces a nitrogen-enriched stream, an oxygen-enriched stream, and an argon-enriched stream, and a sidearm column having a top stream comprising argon, the sidearm column receiving the argon-enriched stream from the distillation column. The process is characterized in that argon recovery in the system is controlled by manipulating the flow rate of argon out of the sidearm column.

In still yet another aspect, the present invention is a process for separating mixtures which comprise oxygen, nitrogen, and argon by cryogenic distillation in a distillation system where the system is comprised of at least one distillation column having a lower pressure section and a higher pressure section, the lower pressure section having an intermediate region, the distillation column producing a nitrogen-enriched stream, an oxygen enriched stream, and an argon-enriched stream. The system also has a sidearm column, the sidearm column receiving the argon-enriched stream from the distillation column. The process is characterized in that argon recovery in the system is controlled by manipulating the flow rate of argon out of the intermediate region of the lower pressure section of the distillation column.

In yet another aspect, the present invention is a process for separating mixtures which comprise oxygen, nitrogen, and argon by cryogenic distillation in a distillation system where the system is comprised of at least one distillation column that produces a nitrogen-enriched stream, an oxygen enriched stream, and an argon-enriched stream, and a sidearm column having an internal repository for the collection of liquid, the sidearm column receiving the argon-enriched stream from said distillation column. The process is characterized in that argon recovery is controlled by manipulating the amount of liquid in the repository of the sidearm column.

In yet another aspect, the present invention is a process for separating mixtures which comprise oxygen, nitrogen, and argon by cryogenic distillation in a distillation system where the system is comprised of at least one distillation column that produces a nitrogen-enriched stream, an oxygen-enriched stream, and an argon-enriched stream, and a sidearm column which receives the argon-enriched stream from the distillation column. The process is characterized in that argon recovery is controlled by manipulating the ratio of liquid flow rate to vapor flow rate in the distillation column, in particular, the low pressure column.

In still another aspect, the present invention is a process for separating mixtures which comprise oxygen, nitrogen, and argon by cryogenic distillation in a distillation system where the system is comprised of at least one distillation column having a feed air stream, the distillation column producing a nitrogen-enriched stream, an oxygen-enriched stream, and an argon-enriched stream, and a sidearm column which receives the argon-enriched stream from the distillation column. The process is characterized in that argon recovery is controlled by manipulating the ratio of liquid flow rate to vapor flow rate in the distillation column through manipulation of the flow rate of the feed air stream.

DETAILED DESCRIPTION OF THE INVENTION

Figure 1:
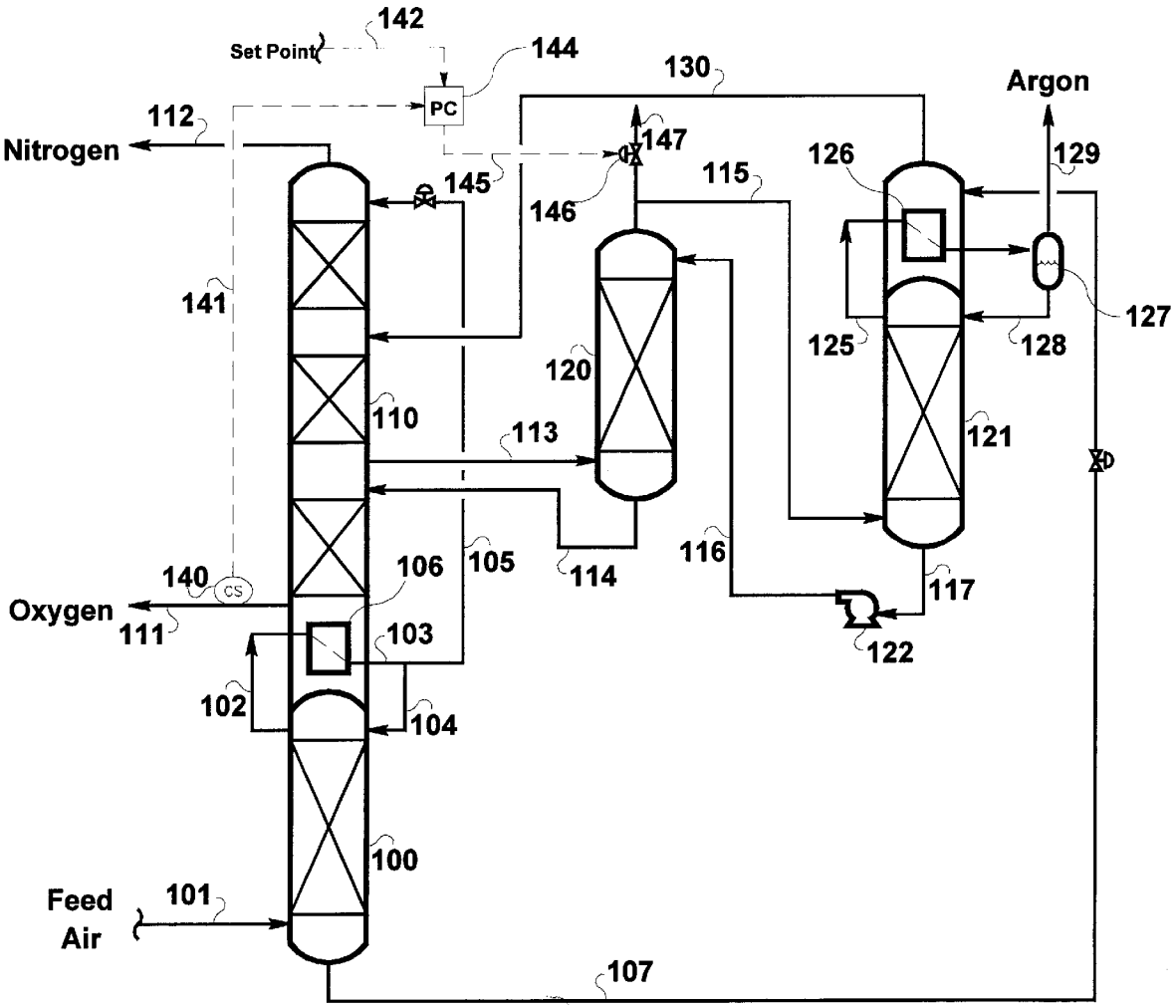
FIG. 1 illustrates a process flow diagram of one embodiment of the present invention where argon is pulled from the top of a first sidearm column.

The present invention provides a process for the cryogenic separation of a mixture containing oxygen, nitrogen, and argon through a cryogenic distillation system. The system is comprised of at least one distillation column that produces a nitrogen-enriched stream, an oxygen enriched stream, and an argon-enriched stream. The system also includes at least one sidearm column which receives the argon-enriched stream from the distillation column. Both the distillation column and sidearm columns typically contain distillation trays or structured packing materials as their internals. Other distributor devices may, however, be used. The process is characterized in that argon recovery is controlled by manipulating the total amount of argon inventory within the system during operation.

More particularly, the present invention teaches efficient and more operable processes for the control of the argon production in a cryogenic air separation process. The invention is applicable to processes which provide an oxygen product stream having argon content ranging from 0.1 mole % to 2 mole % argon and the production of argon with any acceptable oxygen concentration but generally with an oxygen content ranging from ppm levels to 3 mole % oxygen. The invention is comprised of manipulating the argon inventory in the coupled system so as to maintain low levels of argon in the oxygen product stream produced at the bottom of the distillation column. The argon inventory of this coupled system can be manipulated by one or more of the following techniques which will be described in detail below. These are:

1. Pull an enriched-argon stream from the coupled system;
2. Accumulate argon-enriched liquid inventory in the sidearm column; and
3. Accumulate argon-enriched inventory in the lower pressure column.

The first technique noted above is to manipulate the argon inventory of the system and is accomplished by pulling an argon-enriched stream from the system as the argon starts to accumulate in the oxygen product stream. The argon-enriched stream could be removed as a vapor, as a liquid, or as a two-phase mixed vapor and liquid stream. There are several potential sources for the stream. One source is at any location in the lower-pressure column where the argon concentration in either the vapor phase or the liquid phase is above the argon concentration in the feed stream to the lower pressure column. This criterion is met in the intermediate region of the lower pressure column, thus making the intermediate region a possible source of the argon removal stream.

Another source of such an argon-enriched stream is any location in the sidearm column system where the argon concentration in either the vapor phase or the liquid phase is above the argon concentration in the feed stream to the lower pressure column. Moreover, anywhere in the entire sidearm column from the bottom to the top, or anywhere in the intermediate section of the lower pressure column where argon is forced to accumulate, are potential candidates to be the source of the enriched argon stream.

The higher the concentration of argon at the selected location, however, the smaller the total amount of inventory that must be removed to affect overall argon recovery from the system. After the inventory is removed, it is preferably stored until such time as it can be reintroduced and recovered. Alternatively, it can be taken to a separate recovery system. Inventory that is removed and retained in an external repository can, at a subsequent time when the process is available to handle it, be returned to the process so that the argon content can be recovered. Whether the inventory is passed to a separate recovery system or is retained for later reprocessing will be dictated by the economics of the particular situation.

The invention will now be described in detail with reference to the embodiment shown in FIG. 1. The compressed feed air stream, which is free of heavy components such as water and carbon dioxide, is cooled to a suitable temperature and introduced as stream 101 to the bottom of the higher pressure column 100. The pressure of this feed stream is generally greater than 3.5 atmospheres and less than 24 atmospheres with a preferred range of 5 to 10 atmospheres. The feed to the higher pressure column is distilled into a higher pressure nitrogen vapor stream 102 at the top and crude liquid oxygen (LOX) stream 107 at the bottom.

Nitrogen stream 102 is condensed in reboiler/condenser 106 to produce liquid stream 103 which is subsequently split into two streams, 104 and 105. Stream 104 is returned to the higher pressure column as reflux; stream 105 is directed to the top of the lower pressure column 110 as reflux. Though not shown for reasons of simplicity, lower pressure column reflux stream 105 is often cooled via indirect heat exchange with another stream prior to introduction to lower pressure column 110. Crude LOX stream 107 is subject to any number of optional indirect heat exchanges and eventually introduced to the lower pressure column 110 as stream 130.

The feeds to the lower pressure column 110 are distilled into lower pressure nitrogen vapor stream 112 at the top and oxygen stream 111 at the bottom. An argon-containing vapor stream is withdrawn from an intermediate location of the lower pressure column as stream 113. This argon containing stream, which may contain between 3 mole % to 25 mole % argon but typically contains between 5 mole % to 15 mole % argon, is passed to the first sidearm column vessel 120 as a bottom feed.

The argon containing feed to the first sidearm column vessel 120 is distilled to reduce the oxygen concentration in the ascending vapor and produces a top vapor 115 and bottom liquid stream 114. The top vapor stream 115 is passed to the second sidearm column vessel 121 and the bottom liquid stream 114 is returned to the lower pressure column 110. The reduced oxygen concentration vapor stream 115 is distilled in the second sidearm column vessel 121 to reduce the oxygen concentration in the ascending vapor and produces a top vapor stream 125 and a bottom liquid stream 117. The top vapor stream 125 is at least partially condensed in reboiler/condenser 126 to form a two-phase stream which is then passed to separator 127 to collect liquid reflux for the second sidearm column vessel 121 as stream 128 and the purified argon stream 129. The bottom liquid stream 117 is transferred to the first sidearm column vessel 120 via pump 122 as stream 116.

Although not shown in FIG. 1, the argon product could also be removed from the second sidearm column vessel as a liquid. In FIG. 1, the sidearm column has been split into two interconnected vessels 120, 121 for illustrative purposes, but no differences arise if only one vessel or more than two vessels are used for the sidearm column.

According to the invention, when the amount of argon being lost from the system in the oxygen product stream 111 increases to an unacceptable level, and it is either not desirable or not feasible to increase the argon production rate, then the argon inventory in the system must be, at least temporarily, decreased. Thus, upon a detection of unacceptable argon loss through the oxygen product stream 111, as indicated by composition sensor 140, the controller 144 compares the measured signal received via line 141 to the desired argon amount, input as a set point, received via line 142. The necessary control action is transmitted via line 145 to control valve 146 which increases the flow rate of vapor stream 147. The controller 144 may constitute only that logic necessary for the above task of argon control, or it may be a part of a larger control scheme or strategy for either a section of the process or the entire process.

The embodiment of the invention described in FIG. 1 has the advantage over the prior art processes in that the argon in the oxygen product stream can be maintained independent of the purity or flow rate of the argon product. It also has the particular advantage that when the removed inventory is retained and reprocessed by the system, the overall production of argon product is increased. This embodiment is particularly advantageous in that it could be easily retrofitted to an existing sidearm column with minimal capital investment because any repositories or large changes necessary do not involve either lower pressure or sidearm columns.

Instead of controlling the argon inventory by pulling a stream from the system, it can be controlled by appropriately accumulating the argon in the system, noted as the second technique above. Accumulation of argon in the sidearm column can be achieved by increasing the argon-enriched liquid inventory in an internal repository. Because everywhere in the sidearm column the argon concentration in the liquid phase is above the argon concentration in the feed stream to the lower pressure column, the internal repository can be located anywhere from the bottom of the sidearm column to the top of the sidearm column. The lower the position of the repository in the column, the lower the argon concentration and thus the repository must be of a larger volume to contain the same amount of argon. The higher the position of the repository in the column, however, the larger the separation from the oxygen product stream and thus the smaller the effect of retaining argon on the amount of argon leaving the system through the oxygen product stream. The location and size of the repository is thus dictated by the economics of the situation.

Figure 2:
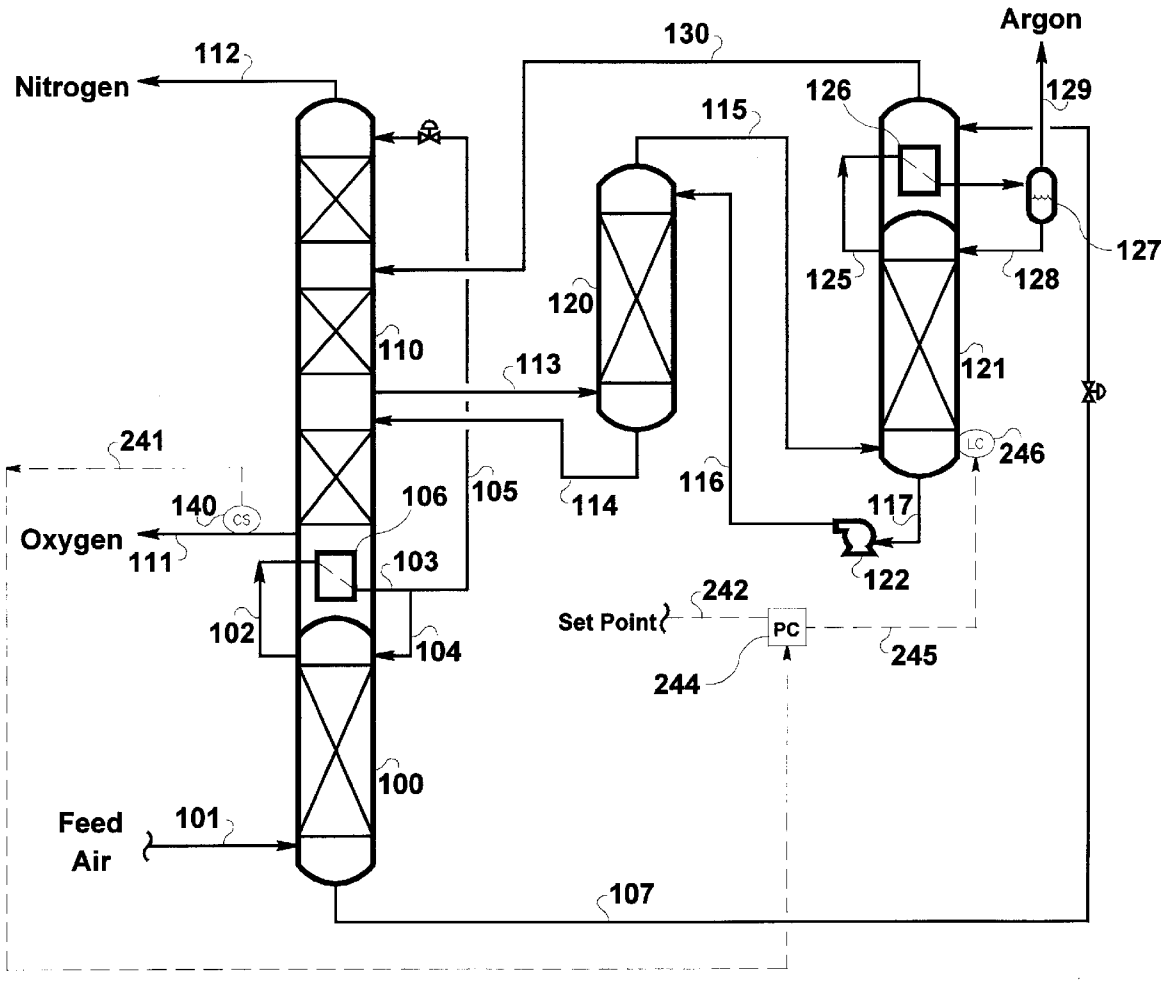
FIG. 2 illustrates a process flow diagram of another embodiment of the present invention where argon is stored in the sump of a sidearm column.

Because the enriched-argon inventory is retained internally, at a subsequent time when the process is available to handle it, the amount of inventory retained can be reduced so that the argon content can be recovered. FIG. 2 shows another embodiment of the invention. For the process in FIG. 2, upon an unacceptable increase of argon in the oxygen product stream 111, as indicated by composition sensor 140, the purity controller 244 compares the measured signal received via line 241 to the desired purity, input as a set point, received via line 242. The necessary control action is transmitted via line 245 to level controller 246 which increases the level of the liquid inventory in the second sidearm column vessel sump.

A particular advantage of this embodiment occurs when the repository can also be used during normal operation to control liquid level in the sidearm column as illustrated in FIG. 2. In such a case, the additional capital investment for the inclusion of a separate repository and its accompanying control equipment is greatly reduced.

There is yet another way to control the accumulation of argon in the system as noted above by accumulating argon enriched inventory in the lower pressure column. Accumulation of argon in the sidearm column relies mainly on increasing the total inventory in the column to increase the amount of argon accumulated. Alternatively, however, one can accumulate argon in the lower pressure column.

Accumulating argon in the lower pressure column is effected by changing the concentration of argon in the intermediate section of the column while holding the total inventory relatively constant. The concentration of argon in the intermediate section can be manipulated by varying either the flow rate of liquid down the column, the flow rate of vapor up the column, or both. To increase the concentration of argon in the intermediate section of the lower pressure column, the liquid and vapor flow rates in the column are manipulated so as to decrease the ratio of the liquid to vapor flow rate. This could be achieved by lowering the liquid flow rate down the column, increasing the vapor flow rate up the column, or a combination of both.

Figure 3:
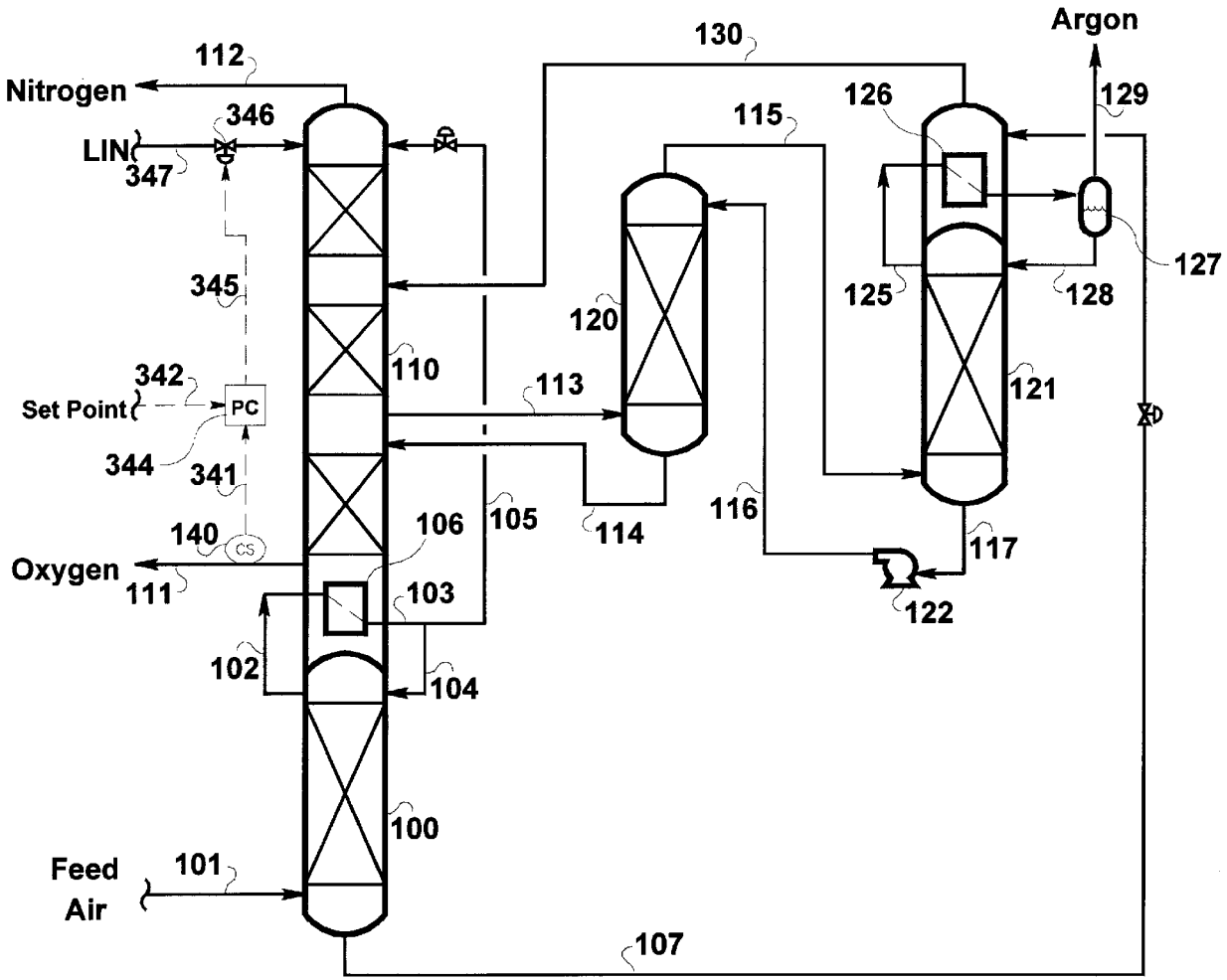
FIG. 3 illustrates a process flow diagram of yet another embodiment of the present invention where a liquid nitrogen stream is used to affect the operation of the lower pressure column.

FIG. 3 shows another embodiment of the invention. For the process in FIG. 3, an external liquid nitrogen reflux stream 347 provides the cooling necessary for the air separation unit and is thus available to be manipulated. Upon the detection of an unacceptable increase of argon in the oxygen product stream 111, as indicated by composition sensor 140, the controller 344 compares the measured signal received via line 341 to the desired value, input as a set point, received via line 342. The necessary control action is transmitted via line 345 to valve 346 which manipulates the flow rate of the liquid nitrogen reflux stream 347.

A decrease in the flow of stream 347 results in a decrease in the ratio of the liquid to vapor flow rates in the column which causes more argon to be forced into the intermediate section of the lower pressure column, thus raising the argon composition. A particular advantage for this embodiment is that because the total liquid inventory of the system is not increased, no additional repositories or extra volume need to be added to be able to retain all the argon and then recover it at a later time.

Figure 4:
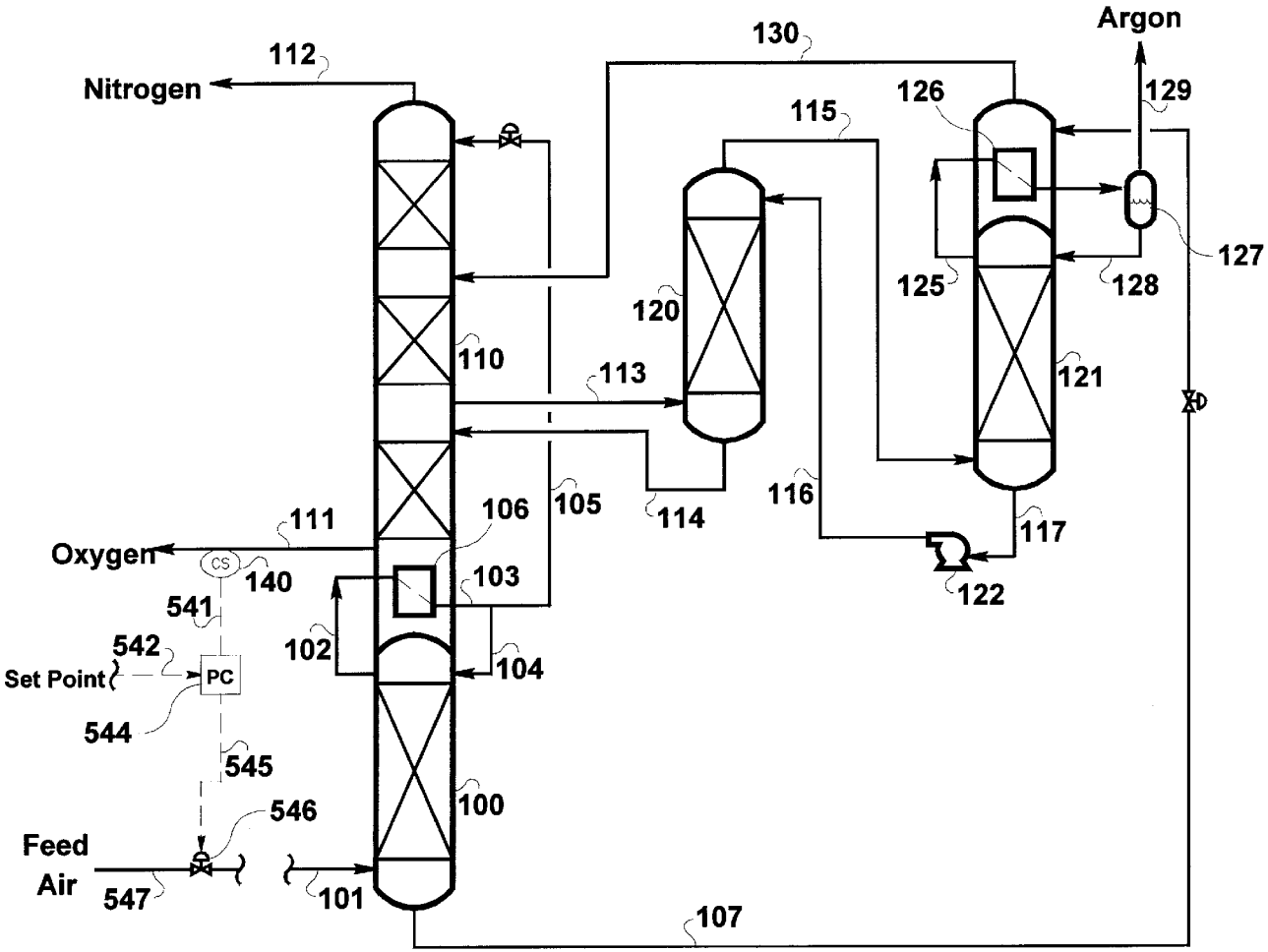
FIG. 4 illustrates a process flow diagram of still yet another embodiment of the present invention where a feed air stream is manipulated to affect the operation of the lower pressure column.

FIG. 4 shows another embodiment of the invention. For the process in FIG. 4, all or a portion of the air feed stream 547 to the cryogenic distillation separation system is available to be manipulated. This stream could be manipulated either before or after the air feed pretreatment, the feed air compressors, or the feed air cooling heat exchangers. Upon detection of an unacceptable increase in argon present in oxygen product stream 111, as indicated by composition sensor 140, the purity controller 544 compares the measured signal received via line 541 to the desired purity, input as a set point, received via line 542.

In FIG. 4, the feed air control element 546 is depicted as a valve but it could be any device that can be used to manipulate the feed air flow rate such as a compressor. An increase in the flow of stream 101 can be made to result in a decrease in the ratio of the liquid to vapor flow rates in column 110 which would cause more argon to be forced into the intermediate section of the lower pressure column. When more argon is forced into the intermediate section of the column, the overall amount of argon in the column increases.

A particular advantage of this embodiment is that the feed air flow rate is a process parameter which is much more readily manipulated as compared to an externally supplied refrigeration stream such as that illustrated in FIG. 3.

EXAMPLE

The method according to the invention is further illustrated by the following example. The operation of restarting an argon sidearm column was simulated dynamically for two scenarios. For both scenarios, the same amount of sidearm column liquid inventory was retained upon the process upset. On restarting, the sidearm column was operated at total reflux and the retained liquid inventory was added to the top of the column as taught by German Patent 34 36 897. For the first scenario, the amount of argon in the oxygen product stream was not controlled by manipulating the argon inventory in the system. For the second scenario, the process according to FIG. 2 of the current invention was simulated. The results are presented in the Table below:

TABLE

| Example | Duration for Off-Spec Oxygen Production (hr) | Argon Production Retained (hr) |
|---|---|---|
| Prior Art | 6 | 0 |
| Invention of FIG. 2 | 0 | 5 |

These results show that for the prior art the argon was out of the control range for six hours and no argon was retained to be recovered at a later time. For the invention of FIG. 2, the argon was never out of the control range and five hours of argon production was retained to be recovered at a later time.

Another important aspect of the present invention is that any of the methods described above may be used alone or in combination with other methods in order to achieve an overall increase in argon production. For example, retaining argon inventory in both the sidearm column and the lower pressure column will lead to overall increases in argon production. Variables to consider in making such a design choice would include argon demand and capital investment constraints.

Although illustrated and described herein with reference to certain specific embodiments, the present invention is nevertheless not intended to be limited to the details shown. Rather, various modifications may be made to the details within the scope and range of equivalents of the appended claims, without departing from the spirit of the invention.

What is claimed:

1. A process for separating mixtures which comprise oxygen, nitrogen, and argon by cryogenic distillation in a distillation system where said system is comprised of at least one distillation column that produces a nitrogen-enriched stream, an oxygen-enriched stream, and an argon-enriched stream, and a sidearm column which receives said argon-enriched stream from said distillation column; the process characterized in that total argon inventory within said system is controlled by removing an argon-rich stream from said system as argon starts to accumulate in an oxygen stream withdrawn from said column.

2. The process of claim 1 wherein said mixture comprising oxygen, nitrogen, and argon is air.

3. The process of claim 1 wherein one or both of said distillation column and said sidearm column has structured packing internals.

4. The process of claim 1 wherein one or both of said distillation column and said sidearm column has distillation tray internals.

5. A process for separating mixtures which comprise oxygen, nitrogen, and argon by cryogenic distillation in a distillation system where said system is comprised of at least one distillation column that produces a nitrogen-enriched stream, an oxygen enriched stream, and an argon-enriched stream, and a sidearm column, said sidearm column receiving said argon-enriched stream from said distillation column; the process characterized in that total argon inventory in said system is controlled by withdrawing an argon enriched stream out of said sidearm column.

6. The process of claim 5 wherein said mixture comprising oxygen, nitrogen, and argon is air.

7. The process of claim 5 wherein one or both of said distillation column and said sidearm column has structured packing internals.

8. The process of claim 5 wherein one or both of said distillation column and said sidearm column has distillation tray internals.

9. A process for separating mixtures which comprise oxygen, nitrogen, and argon by cryogenic distillation in a distillation system where said system is comprised of at least one distillation column having a lower pressure section and a higher pressure section, said lower pressure section having an intermediate region, said distillation column producing a nitrogen-enriched stream, an oxygen enriched stream, and an argon-enriched stream, and a sidearm column, said sidearm column receiving said argon-enriched stream from said distillation column; the process characterized in that total argon inventory in said system is controlled by withdrawing an argon enriched stream out of said intermediate region of said lower pressure section of said distillation column as argon starts to accumulate in an oxygen product stream from said column.

10. The process of claim 9 wherein said mixture comprising oxygen, nitrogen, and argon is air.

11. The process of claim 9 wherein one or both of said distillation column and said sidearm column has structured packing internals.

12. The process of claim 9 wherein one or both of said distillation column and said sidearm column has distillation tray internals.

13. A process for separating mixtures which comprise oxygen, nitrogen, and argon by cryogenic distillation in a distillation system where said system is comprised of at least one distillation column that produces a nitrogen-enriched stream, an oxygen enriched stream, and an argon-enriched stream, and a sidearm column having an internal repository for the collection of liquid, said sidearm column receiving said argon-enriched stream from said distillation column; the process characterized in that total argon inventory in said system is controlled by controlling the amount of liquid in said repository of said sidearm column.

14. The process of claim 13 wherein said mixture comprising oxygen, nitrogen, and argon is air.

15. The process of claim 13 wherein one or both of said distillation column and said sidearm column has structured packing internals.

16. The process of claim 13 wherein one or both of said distillation column and said sidearm column has distillation tray internals.

17. The process of claim 13 wherein said sidearm column has a sump located at the bottom of said sidearm column and wherein said repository located inside said sidearm column is the sump.

18. A process for separating mixtures which comprise oxygen, nitrogen, and argon by cryogenic distillation in a distillation system where said system is comprised of at least one distillation column that produces a nitrogen-enriched stream, an oxygen-enriched stream, and an argon-enriched stream, and a sidearm column which receives said argon-enriched stream from said distillation column; the process characterized in that total argon inventory in said system is controlled by manipulating the ratio of liquid flow rate to vapor flow rate in said distillation column.

19. The process of claim 18 wherein said mixture comprising oxygen, nitrogen, and argon is air.

20. The process of claim 18 wherein one or both of said distillation column and said sidearm column has structured packing internals.

21. The process of claim 18 wherein one or both of said distillation column and said sidearm column has distillation tray internals.

22. The process of claim 18 wherein said ratio is decreased to improve overall argon production.

23. A process for separating mixtures which comprise oxygen, nitrogen, and argon by cryogenic distillation in a distillation system where said system is comprised of at least one distillation column having a feed air stream, said distillation column producing a nitrogen-enriched stream, an oxygen-enriched stream, and an argon-enriched stream, and a sidearm column which receives said argon-enriched stream from said distillation column; the process characterized in that total argon inventory in said system is controlled by manipulating the ratio of liquid flow rate to vapor flow rate in said distillation column through manipulation of the flow rate of said feed air stream.

24. The process of claim 23 wherein said mixture comprising oxygen, nitrogen, and argon is air.

25. The process of claim 23 wherein one or both of said distillation column and said sidearm column has structured packing internals.

26. The process of claim 23 wherein one or both of said distillation column and said sidearm column has distillation tray internals.

27. The process of claim 23 wherein said ratio is decreased to improve overall argon production.

* * * * *